US009131538B2

(12) United States Patent
Ferrari et al.

(10) Patent No.: US 9,131,538 B2
(45) Date of Patent: Sep. 8, 2015

(54) ELECTRODE PASTE FOR ELECTRODES IN A GRAPHITE AND/OR ANTHRACITE WITH HYDROCARBON BASE

(75) Inventors: Sandro Ferrari, Bergamo (IT); Irma Cavallotti, Bergamo (IT); Giuseppe Conti, Milan (IT); Maurizio Dusi, Bagnolo Mella (IT)

(73) Assignee: ITALGHISA S.P.A., Bagnolo Mella (Brescla) (IT)

( * ) Notice: Subject to any disclaimer, the term of this patent is extended or adjusted under 35 U.S.C. 154(b) by 0 days.

(21) Appl. No.: 13/514,091

(22) PCT Filed: Dec. 13, 2010

(86) PCT No.: PCT/EP2010/069547
§ 371 (c)(1),
(2), (4) Date: Jun. 6, 2012

(87) PCT Pub. No.: WO2011/073153
PCT Pub. Date: Jun. 23, 2011

(65) Prior Publication Data

US 2012/0248385 A1 Oct. 4, 2012

(30) Foreign Application Priority Data

Dec. 16, 2009 (IT) ..... MI2009A2203

(51) Int. Cl.
*H01B 1/04* (2006.01)
*H05B 7/09* (2006.01)

(52) U.S. Cl.
CPC ... *H05B 7/09* (2013.01); *H01B 1/04* (2013.01)

(58) Field of Classification Search
CPC Y02E 60/122; H01M 10/0525; H01M 4/587; H01M 10/052; H01M 4/133; H01B 1/04
USPC ..... 252/502
See application file for complete search history.

(56) References Cited

U.S. PATENT DOCUMENTS

| | | | | |
|---|---|---|---|---|
| 1,677,406 | A * | 7/1928 | Perl | 127/37 |
| 2,645,583 | A | 7/1953 | Stanko et al. | |
| 4,098,608 | A * | 7/1978 | Matty et al. | 75/255 |
| 4,490,826 | A | 12/1984 | Kawamata et al. | |
| 6,103,373 | A * | 8/2000 | Nishimura et al. | 428/368 |
| 6,235,184 | B1 | 5/2001 | De Carvalho et al. | |
| 2002/0014404 | A1 | 2/2002 | De Carvalho et al. | |
| 2004/0028993 | A1 * | 2/2004 | Jousse et al. | 429/44 |
| 2005/0254545 | A1 | 11/2005 | Daimer | |
| 2007/0267604 | A1 * | 11/2007 | Butcher et al. | 252/511 |
| 2010/0239915 | A1 * | 9/2010 | Hochgatterer et al. | 429/231.95 |
| 2011/0232736 | A1 * | 9/2011 | Goldstein et al. | 136/256 |

FOREIGN PATENT DOCUMENTS

| | | | |
|---|---|---|---|
| CN | 1047006 | A | 11/1990 |
| CN | 101289751 | A | 10/2008 |
| DE | 2343504 | A1 | 3/1975 |
| EP | 0142476 | A2 | 5/1985 |
| EP | 1120453 | A2 | 8/2001 |
| EP | 1130077 | A2 | 9/2001 |
| EP | 1406473 | A1 | 4/2004 |
| SU | 358797 | | 1/1973 |
| WO | 03029496 | A1 | 4/2003 |
| WO | 2007018880 | A1 | 2/2007 |
| WO | WO 2009012899 | * | 1/2009 |

OTHER PUBLICATIONS

Mirchi et al., "Alcan Characterization of Pitch Binder Evaluation and Process Changes in an Aluminium Smelter", Light Metals 2002, Edited by Wolfgang Schneider, TMS, 2002.
International Search Report, dated Feb. 9, 2011, from corresponding PCT application No. PCT/EP2010/069547.
Russian Office Action, from corresponding RU application, Dated 2014.

* cited by examiner

*Primary Examiner* — Harold Pyon
*Assistant Examiner* — William Young
(74) *Attorney, Agent, or Firm* — Young & Thompson

(57) ABSTRACT

A Soederberg electrode with low PAH emission that can be used in electro-thermal processes for the production of metal materials, preferably ferro-alloys, which can be obtained from an electrode paste with a base of a carbonaceous material, fine graphite, carbohydrates and water and/or PEG.

9 Claims, No Drawings

ELECTRODE PASTE FOR ELECTRODES IN A GRAPHITE AND/OR ANTHRACITE WITH HYDROCARBON BASE

The object of the present invention is an electrode paste suitable for use for the construction of electrodes of the self-baking type, via the so-called Soederberg process, which demonstrate suitable properties for use in the processes of production of ferro-alloys in submerged arc furnaces.

More particularly the object of the present invention is a paste as defined above which is not included in the classification as R45, according to the provisions of directive 94/69/CE, directive 2006/8/CE of 23 Jan. 2006 and subsequent amendments, and which is able to guarantee very low emissions of PAHs (polycyclic aromatic hydrocarbons) during use in the production process.

The process of production of iron alloys is based on the principle of manufacture through electrometallurgy which consists in the chemical reduction of one or more minerals, typically in the form of oxides, by means of pit coal or its derivatives, which therefore act with a reducing function. In said process electric furnaces of the reduction type with resistance arc are used which require the use of electrical energy to supply the smelting heat, which therefore is to be considered as "obligatory electrical use" since the electrical energy cannot be substituted for this production process. More particularly, in the production of ferro-alloys such as ferrosilicon, ferromanganese and ferrochrome, use is made of resistance furnaces with submerged arc (process in arc furnace) which in the production phases have the electrodes immersed in the inorganic charges of the furnace. In this process the minerals of iron, silicon and manganese are reduced and separated into the appropriate metal alloys.

The electrodes used in these processes, known as Soederberg electrodes, are obtained, preferably in situ, from a self-baking electrode paste with a base of powdery carbonaceous materials such as for example calcined or electro-calcined anthracite, mixed together by means of a binding substance (binder), generally pitch or tar. Once prepared, the paste is inserted in a container with suitable resistance during transformation of the electrode material which takes place in the furnace and, after having charged the furnace with the mineral-based charge, said container is lowered down in the proximity of the charge surface, then feeding electricity in the form of an electric arc: thanks to the high temperatures generated by the heat deriving from the electric arc, generally between 1000 and 2000° C., the charge is smelted and the electrode paste hardened inside the container.

The pitch or tar used for these electrode pastes has a high content of polycyclic aromatic hydrocarbons (PAH) which are harmful to the health of humans since they are formed by a plurality of aromatic rings, also condensed one in relation to the other: in fact the legal provisions in the area of industrial hygiene and health monitoring, compulsory for employers, lay down in this particular case that said pitch (or tar) be classified as carcinogenic (R45) should it contain benzo[a]-pyrene in a percentage higher than 0.005% weight/weight (Einecs no. 200-028-5) and that consequently all safety measures have to be adopted to avoid prolonged exposure by staff to said substances.

Moreover legislative decree 81/08, in particular subsection II, Arts. 233-245, relating to safety in the workplace, obliges companies to find replacements for substances classified as R45 or, in the case wherein no replacement is available on the market, to adopt a multitude of actions to protect workers in the workplace such as, for example, valuation of the exposure risk, measuring of carcinogenic or mutagenic agents, the planning, programming and monitoring of processes so that there is no emission of carcinogenic or mutagenic agents in the air and health monitoring.

Therefore, in order to meet legal requirements, a multiplicity of actions are required which entail greater complexity of management of the plant using these substances with obvious additional financial expense.

It should also be underlined that electrode pastes are not available on the market which are suitable for use in the Soederberg process and free from R45 labelling. This entails a further disadvantage for the production process of ferro-alloy based materials.

Moreover, due to the high temperatures in the submerged arc furnaces, said PAHs being the lighter hydrocarbon components of the pitch or tar, they volatilise so that, also from the viewpoint of the emissions of the ferro-alloys production cycles, the use of known electrode pastes is disadvantageous. In fact during the production of ferro-alloys there is constant emission into the outside environment, and into the work environment, of PAHs such as benzo(a)pyrene, chrysene, dibenzanthracene, which are released during baking of the pastes, thus exposing the staff to a high risk of occurrence of serious work-related illnesses.

Therefore, although the use of said pastes is a common art in the production of ferro-alloys in electric furnace with open, closed and semi-closed resistance arc, the indications gained from sectorial studies by authoritative bodies, such as ISPESL, indicated as a solution to the aforesaid problem the use of pre-baked electrodes. However pre-baked electrodes are not normally used in the production of ferro-alloys due both to the increased complexity of management of the process which their use entails and the high costs of the same. Moreover the manufacture of pre-baked electrodes requires in any case the use of pitch and/or tar, shifting the problem of emissions upstream of the production chain.

As a solution to the problem of PAH emissions described above, both processes of post-treatment of fumes to reduce the PAH emissions and pastes for electrodes containing smaller quantities of PAHs have been proposed in the art.

For example in the patent application EP1120453 a description is given of the abatement of PAHs in output from the furnace using processes of fume post-treatment with specific Ni—Mo catalysts supported on alumina or silica, as an alternative to other processes of post-treatment via the physical or biological route. However the use of a process of post-treatment of fumes entails an extension of the existing plant following the addition of said post-treatment unit: this represents an increase in plant and running costs with consequent increase in the complexity of management of the plant. Moreover the processes of post-treatment of fumes do not allow the problem of the R45 classification of the electrode pastes to be overcome.

In the patent application EP 1130077A2 a process is described for the preparation of hydrocarbon binders with a low PAH content compared to the traditional ones deriving from pit coal which involves subjecting the pitch or tar to combined reactions of cracking, dehydrogenation and polymerisation in order to reduce the content of PAHs to 95% in the pitch thus obtaining PAH emissions lower than 6 mg/m$^3$. This solution however is costly and impracticable in light of the complexity of the plant for pre-treatment of the pitch. Moreover it is not described how to avoid the R45 classification of the base electrode pastes. In fact a reduction of PAHs in the paste of up to 95% does not ensure a content of PAHs below 0.1% as foreseen by law to avoid said classification since this content depends on the concentration of PAHs in the pitch or tar used and on the quantity of pitch in the paste.

The patent application CN 101289751 describes the use of electrode pastes containing pitch in a maximum quantity of 5%, and other additional binders such as silicone binders and boron carbides and phenolic resins in order to achieve a considerable reduction in the PAHs emitted. This electrode paste, although having a reduction in the emissions of PAHs, cannot avoid the R45 classification since the presence of pitch for a maximum of 5% does not guarantee that the paste contains PAHs, in particular benzo(a)pyrene, in a quantity below 0.005% as required by law to avoid said classification: even if the concentration of benzo(a)pyrene or other PAHs were slightly higher than 0.005% it would be obligatory to classify the paste as R45. Moreover the use of phenolic resins, although allowing a reduction in PAH emissions, entails noxious emissions of formaldehyde while the use of silicone binders and/or boron carbides in the percentages foreseen entails prohibitive costs of said electrode paste.

In the U.S. Pat. No. 6,235,184 and in the patent application US2002/0014404 a process is described for the production of pre-baked anodes derived from petroleum coke and manufacturing residues of electrodes for the production of aluminium wherein molasses of cane sugar or varyingly refined sugars in solid form are used in place of the pitch: even if it is explained that this process can also be extended to the manufacture of Soederberg electrodes using the same mixture, no item of data is however given in relation to the physical properties of Soederberg electrodes obtained by means of this composition. In addition, as stated in the patent applications WO 03/029496 and WO 2007/018880, the use of sugars in the preparation of electrode pastes leads to the formation of porous and fragile electrodes, with low density, high porosity, high shrinkage and poor mechanical properties.

Tests performed by the Applicant have also shown that the use of similar composition in the production of Soederberg electrodes gives rise to material with performances lower than those of commercial electrodes containing pitch. Reference should be made to the comparison examples attached to this application.

The patent applications WO 03/029496 and WO 2007/018880 describe the use of sugars with additives of particular reagents such as phosphates and/or toluene sulphonates as impregnants and/or binders in the production of carbonaceous products based on petroleum coke and production scrap having an improved density of the material and a reduced tendency to form a solid foam. Nevertheless, also in said applications, there is no item of data relating to the physical properties of Soederberg electrodes obtained by means of this formula. Moreover in said applications reference is not made as to how to avoid the R-45 labelling of the paste.

The object of the present invention is to find pastes for electrodes for the electro-thermal production of metals, more particularly ferro-alloys, able to overcome, at least in part, the disadvantages and difficulties of known pastes described above, and which are able to release quantities of PAHs far below what is laid down by law for the emissions in conventional arc furnaces, and therefore do not require the use of plants of post-treatment of fumes for the abatement of said PAHs.

A further object is to provide such a paste which is not economically disadvantageous compared to a conventional paste classified as R45 and which can be adopted in a plant which uses Soederberg electrodes without significant changes to the process and to the plant.

Another object is to provide such a paste which is not carcinogenic and not classified as R45.

Yet another object is providing such a paste as indicated above which is able to provide electrodes having good electrical/thermal conductivity and mechanical properties preferably similar, more preferably improved, in respect of electrodes obtained with known pastes in Soederberg electrodes for the production of iron alloys.

These objects are achieved by means of an electrode paste which has the characterising features indicated in the independent claim.

Further advantageous features of the invention form the object of the dependent claims.

The electrode paste which is the object of the present invention is suitable for obtaining self-baked electrodes for the electro-thermal production of metal alloys, more particularly ferro-alloys, and comprises a mix (A) of fine powdery graphite and/or fine anthracite (herein below said powder is referred to as "the fine") and at least one carbohydrate admixed with a solvent and/or dispersant for said carbohydrate such as, for example, water and/or polyethylene glycol (PEG) of formula $HO(CH_2CH_2O)_nH$ having appropriate molecular weight, said component having also plasticizing and/or fluidizing properties The acronym PEG is intended to identify oligomers and polymers of the ethylene oxide with a molecular weight below 20,000 g/mol.

"Fine graphite" here is intended to identify a graphite having such particle size that its particles have, for at least 95%, preferably for at least approximately 97%, dimensions, or an average dimension, below 0.2 mm, preferably below 0.1 mm.

The term "fine graphite" here is intended to comprise also superfine graphite and micronized graphite (ultrafine) which generally show particles with dimensions respectively of the order of 0.025 mm or below (25 microns) and of the order of 0.010 mm or below.

"Fine anthracite" here is intended to identify a powder derived from the grinding of calcined and/or electro-calcined anthracite having minimum carbon content of 95% with particle size equal to that described for the "fine graphite" and which does not contain or emit substances considered carcinogenic when subjected to heating.

In said mix (A), the concentration of the aforesaid fine is comprised between 60% and 30% by weight with respect to the total weight of the mix; the concentration of the carbohydrate is comprised between 30% and 50%; the concentration of water or of the PEG is comprised between 5% and 20%.

In practice said mix (A) acts as binder for the particles of the powdery carbonaceous material (B).

Preferably in the mix (A) the fine is micronized and the dispersant/solvent used is PEG (with weight average molecular weight comprised between 1000 and 4000).

Said PEG, more particularly PEG 1500-4000, is particularly preferred in that it causes a further improvement in the mechanical properties of the material (higher modulus of compression rupture) making it particularly suitable for withstanding conditions of strong thermal stress during its phase of transformation. Reference should be made to the examples.

Alternatively as solvent/dispersant another solvent/dispersant can be used with plasticizing and/or fluidizing properties for a paste similar to those of PEG, such as for example thermoplastic polymers free from aromatic rings and which do not emit substances classified as R45 during the pyrolysis process and which have a pour point below 120° C.

The electrode paste of the present invention comprises moreover a coarse phase formed by a powdery carbonaceous material (B) which is mixed homogeneously with said mix (A).

The particles of the powder of said carbonaceous material (B) have an average dimension or dimensions, for at least 95%, preferably for approximately 97%, greater than 0.2 mm, preferably comprised between 0.5 and 20 mm, more preferably between 0.5 and 1 mm.

As "coarse" carbonaceous material, materials can be identified here whose particles have dimensions even greater than 20 mm and up to 100 mm.

Said carbonaceous material (B) is essentially made up of carbon and is not a metallic material; moreover said material preferably does not contain essentially metals and/or metal oxides since, if they may be present, they are in quantities generally lower than 10% by weight in relation to the total weight of the paste (A)+(B). In fact the quantity of metals and/or metal oxides must be low as the electrode deriving from the paste (A)+(B) should preferably not be the source of carboreduction reactions which increase the consumption of paste, but only of phenomena of electricity transport.

In the paste (A)+(B) for electrode of the present invention (hereinafter referred to as "paste") the concentration of carbonaceous material (B) is comprised between 90% and 10% by weight in relation to the total weight of the paste, preferably between 80% and 30%, more preferably between 70% and 35%, while the concentration of the mix (A) in said paste is the remaining part to 100.

Referring to the composition by weight of the final paste (A)+(B), the concentration of coarse carbonaceous material (B) is preferably comprised between 60-40%, that of the carbohydrate is comprised between 10 and 30% and the concentration of the fine is comprised between 5 and 25%. The water, or preferably the PEG, and the optional additives have a concentration which represents the remaining part to 100% of the aforesaid composition.

As mentioned, the mix (A) allows the particles of the carbonaceous material (B) to bind effectively one with the other, therefore acting as binder for said material (B). In fact the mix (A), which is prepared beforehand before being mixed with the carbonaceous material (B), shows extensive fluid behaviour in a wide range of temperatures and is not subject to separation.

The rheological properties of the mix (A) may vary as a function of the use of water or of PEG, of the temperature, of the concentration of its components and of the optional presence of additives as described herein below: therefore said rheological properties may be such as to reach a high fluidity in order to bind effectively the matrix (material (B)), generally made up of grains packed into a column giving at the same time high compactness to the paste and filling the empty spaces with "fine" material.

It should be noted that in the mix (A), the mixture of water (and/or PEG) and the carbohydrate represents the binder of the fine powder: said organic binder, capable of graphitising, is advantageous in that it only generates non-metallic carbonaceous residues which do not contaminate the ferro-alloy, unlike inorganic binders which do not graphitise, used in metal-based Soederberg electrodes.

In the mix (A) the carbohydrates can be chosen from monosaccharides, disaccharides, oligosaccharides and polysaccharides.

More particularly, the monosaccharides are preferably chosen from ribose, ribulose, glucose, fructose, galactose; the disaccharides are preferably chosen from cellobiose, maltose, lactose, saccharose, trehalose; the polysaccharides are preferably chosen from starch, cellulose, chitin, callose, laminarin, xylan, mannan, fucoidan and galactomannan. As oligosaccharide raffinose can be mentioned.

More particularly among the carbohydrates, those are preferred which contain one or more molecules of fructose, able to therefore to caramelise as the temperature increases.

As an alternative to the carbohydrate derivatives and/or carbohydrates indicated above it is possible to use substances with a high content of sugars (fructose and glucose or xylose, lactose and maltose) and able to caramelise at high temperatures, for example molasses, maple syrup, malt extract and other substances with a high content of sugars. High content of sugars refers to a content of at least 50%, preferably at least 70%.

As mentioned, the mix (A) may optionally contain inorganic and/or organometallic P, B, Si, Fe-based additives such as boric acid, phosphoric acid or ammonium phosphate, ferrocene, (cyclopentadienyl iron, $Fe(C_5H_5)_2$), stearine, saturated fatty acids, mono-unsaturated or polyunsaturated fatty acids, organic acids such as acetic acid, propionic acid, citric acid or a mixture thereof, to increase the rheological properties of said mix (A) and/or to modify the carbon yield of the sugar during pyrolysis, and/or promote/facilitate (catalyse) the processes of graphitising of the carbon-based compounds, such as carbohydrates.

Said additives can be used in a total quantity comprised between 0.1% to 10% in relation to the weight of the final paste, preferably between 1% and 8%.

When the additive is based on metalloids and transition metals its quantity is preferably comprised between 1% and 5%, more preferably 1%.

In a particularly preferred embodiment the carbohydrate is saccharose (normal sugar), optionally added with an organic acid, such as acetic and stearic acid, or inorganic such as boric or silicic acid.

In another particularly preferred embodiment the carbohydrate is saccharose dissolved in PEG and added with the boric acid additive.

The carbonaceous material (B) used in the paste of the present invention may be one or more graphitisable carbonaceous materials, i.e. suitable for being graphitised, or one or more graphitic materials, or their mixtures, preferably a graphitic material.

Graphitisable material refers here to a material which is able to generate crystals of graphite following heating at high temperatures, for example between 1500 and 2500° C., and/or by means of electro-thermal treatment. Said graphitisable material may also contain, at least in part, graphite crystals.

As graphitisable material mention can be made, for example, of fossil carbon (coal), coke, pet coke, charcoal and amorphous porous carbons (active carbon).

The term "coal" here is intended to identify the various types of fossil carbon, from the low-ranking one such as peat and the lignites.

The term "coke" refers here to a carbonaceous material obtained from the pyrolysis of sub-bituminous fossil carbons of intermediate rank, performed at temperatures of around 1000° C., in the absence of oxygen. This process "densifies" the texture of the carbon in the presence of the residues of the minerals, giving the material the right mechanical consistency for its use in metallurgical processes. If the pyrolysed carbonaceous source derives from petrochemical streams (bituminous sands, asphaltenese, etc.) the product obtained through pyrolysis is defined as pet coke.

The term charcoal is intended here to refer to a fragile carbonaceous material, extremely lightweight and porous, obtained essentially through pyrolysis in the presence of oxygen at moderate temperatures (around 700° C.) which allow the formation of amorphous carbon from vegetal and animal biomasses, ligninic pulps, scrap from woodworking, etc., after separation of water and volatile compounds of organic nature. In general these are therefore materials different from graphite which, with different yields, can be graphitised via thermal and/or electro-thermal treatment.

As graphitic material anthracite and graphite can be mentioned.

Anthracite here refers to a variety of carbon which has a high content of carbon (90%), associated with a relatively low quantity of volatile material (2%) and has a substantially crystalline structure.

Graphite here refers to the allotropic form of carbon, where the atoms are positioned at the vertices of hexagonal units, which are joined to create parallel planes which can easily be exfoliated. The graphite crystals have the form of flattened small laminae with a hexagonal outline.

As carbonaceous material (B), in the paste of the present invention a mix of graphitisable carbonaceous material with graphitised material can be used.

In the pastes of the present invention it is also possible to use, as carbonaceous material B), anode or cathode grade carbon with an ash content below 0.3%, able to graphitise at a temperature below 2700° C. and containing less than 0.1% in weight of iron.

Preferably the carbonaceous material (B) used in the paste of the present invention is calcined and/or electro-calcined graphite and/or anthracite, more preferably electro-calcined anthracite.

The paste of the present invention is free from ceramic materials and hardens when subjected to high temperature, thanks to the process of graphitising and/or of baking of the binder thus obtaining a rigid self-supporting (self-supported) electrode.

The paste and the binder (A) of the present invention can be prepared with the known processes of mixing of powders with liquids.

More particularly, in the preparation of the binder (A) it is preferable to mix the ingredients in a mixer kept at the temperature of 60-90° C. for a few hours until a mixture which is fluid when hot and semi-solid or solid when cold is obtained. Subsequently said binder (A) is mixed with the carbonaceous material (B), while stirring or mixing, in order to obtain a homogenous paste in accordance with the present invention.

It is also possible to mix first the graphite powders, carbonaceous material (B), sugar (or other solid carbohydrates in powder form) so as to obtain a homogenous powdery mixture and later add to this mixture the dispersant and optional liquid components (for example acetic acid) while stirring, obtaining the paste of the present invention.

After having obtained the paste of the present invention, it is possible to use it by inserting, it in the furnace for production of the ferro-alloys in place of the conventional electrode paste so as to obtain in situ a self-baked Soederberg electrode.

The compositional features of the electrode paste of the present invention are based on the total absence of tar pitch used in the known art as binders, which are found to be classified as category 2 carcinogenic, with the risk phrase for R45 "may cause cancer", toxic and which are the primary source of emission of PAHs in the workplace and in the emissions in the atmosphere.

It was unexpectedly found that a paste for Soederberg electrodes comprising also a micronised or fine graphite phase entails improved properties of the final material since data from literature suggested that in conventional Soederberg electrode pastes, or for the formation of pre-baked electrodes, the use of phases of materials with fine particle size had a detrimental effect on the properties of the same material (A. A. Mirchi, et al. "Alcan Characterization of Pitch Performance for Pitch Binder Evaluation and Process Changes in an Aluminium Smelter", Light Metals 2002, Edited by Wolfgang Schneider, TMS, 2002.)

Moreover the Applicant has unexpectedly found that the pastes of carbonaceous materials containing said carbohydrates without added reagents and in a mix with the fine are able to produce compact electrodes, with limited shrinkage, also having mechanical properties and electrical/thermal conductivity properties comparable to those provided by known pastes and such as to allow their use as electrodes for arc furnaces for ferro-alloys, unlike what is reported in the art. Refer to the examples.

Without wishing to be bound to any theory, it is presumable that:

- the fine phase minimises the weight loss occurring in the decomposition of the sugar at high temperature and that therefore its mixing with a coarse phase made up of the carbonaceous material (B) entails an improvement in the structure and in the mechanical properties of the final electrode which can be obtained from said paste;
- said fine phase carbonises in a solid matrix at a higher temperature compared to the baking temperatures of the paste with a consequent modest loss of weight during baking.

Additionally it is presumable that the mix (A) containing fine graphite and/or anthracite, which acts as binder of the coarse material, is able to fill effectively the spaces between the coarse particles of the carbonaceous material (B) generally having larger dimensions than the fine, packing in a column and conferring greater compactness to the paste. Moreover it is presumed that said paste is characterised by phases of thermal hysteresis, constituted by the softening and later hardening of shorter duration, guaranteeing during the production process an electrical conductivity similar or better compared to the prior art.

The advantages of the paste for electrodes according to the present invention are the total absence of aromatic hydrocarbon compounds which can be classified with the risk phrases R45 in its pristine form, and a level of emissions of aromatic hydrocarbons classified with risk phrases R45 during the Soederberg process which is 1000 times lower than the current known paste. This paste enables electrodes to be obtained with characteristics of electrical and thermal conductivity and mechanical strength suitable for use in furnaces for the production of the ferro-alloys.

Since in the production of ferro-alloys effective management of the self-baked electrode is fundamental, which should be considered an integral part of the production process, the use of the material which is the object of the present patent application is likewise essential also for the abatement of the emissions of PAHs in the work environment and in the outside environment.

More particularly, the process of preparation of ferro-alloys which uses the paste of the present invention comprises:

- insertion of the paste in a container suitable for withstanding the conditions of pyrolysis present in the furnace;
- charging said furnace with a mineral-based charge;
- lowering said container down in the proximity of the charge surface, then feeding the electricity in the form of an electric arc and consequent smelting of the charge and hardening of the electrode paste inside the container.

Following the reaction of reduction, the electrode which is formed in situ is partially consumed and therefore it is necessary to add further paste in the container in order to ensure the continuity of the process.

The addition of said paste may constitute a critical point given the different physical state of the paste and of the baked electrode which does not guarantee in general the physical continuity between the two elements given also the shrinkage which the paste generally undergoes during baking: the Applicant has found that the paste of the present invention shows a shrinkage comparable with the known pastes and therefore acceptable for use as precursor of self-baked Soederberg electrodes.

Additionally said paste (A)+(B) is able to reach almost immediately the physical continuity with the electrode already baked, unlike what occurs to the known pastes. This allows avoidance of possible breakages of the electrode which require the interruption of the process.

Moreover the Applicant has also found that the binder (A) used in the paste of the present invention can also be used as such as a paste for the formation of self-baked Soederberg electrodes, although having greater shrinkages compared to the paste of the present invention and being therefore difficult to use in a column as used in the current state of the art.

Without departing from the scope of the invention, a person skilled in the art may make to the paste previously described all the changes and improvements suggested by normal experience and/or by the natural evolution of the art. The following are some non-limiting examples illustrating the present invention.

EXAMPLES

Example 1

This example aims is to illustrate the properties of the binder (A) of the electrode paste of the present invention when used as such, i.e. without the addition of a coarse structuring material (B), to obtain self-baked Soederberg electrodes. The pastes prepared are compared with a Soederberg paste, commercially known as ELKEM electrode paste and produced by the same, which contains 25% pitch and 75% electro-calcined anthracite. This paste will hereinafter be referred to as commercial paste.

The properties of this binder (A) have been compared with the properties of the commercial paste.

Binders (A) were prepared with the following features:

| Ingredient | Green 1 (%) | Green 2 (%) | Green 3 (%) |
|---|---|---|---|
| Coarse anthracite | — | — | — |
| Fine graphite (0-0.1 mm) | 50 | 50 | 50 |
| Saccharose | 40 | 40 | 42 |
| Acetic acid | 4 | — | — |
| Boric acid | — | 2 | |
| Stearic acid | 2 | — | — |
| $H_2O$ | 4 | 8 | 8 |

| Ingredient | Green 1 (g) | Green 2 (g) | Green 3 (g) |
|---|---|---|---|
| Coarse anthracite | — | — | — |
| Fine graphite (0-0.1 mm) | 500 | 500 | 500 |
| Saccharose | 400 | 400 | 420 |
| Acetic acid | 40 | — | — |
| Boric acid | — | 20 | — |
| Stearic acid | 20 | — | — |
| $H_2O$ | 40 | 80 | 80 |

In the Green 1 binder, the saccharose, the water and the acetic acid were mixed for approximately 20 min. and kept in the stove at a temperature of 80° C. for 10 hours. The binder was transformed into a homogeneous mixture with viscosity and consistency similar to honey. Subsequently 500 g of fine graphite and 20 g of stearic acid were added, mixing it all together for approximately 30 min.

In the Green 2 binder, the saccharose, the water and the boric acid were mixed for approximately 20 min. and kept at a temperature of 80° C. for 10 hours.

The binder was transformed into a homogeneous mixture with viscosity and consistency similar to honey. Subsequently 500 g of fine graphite were added, mixing it all together for approximately 30 min.

In the Green 3 binder the fine graphite, the saccharose and the water were added and mixed together for approximately 60 min.

For all the binders (Green 1, Green 2 and Green 3) a homogeneous mix was obtained with a soft consistency.

Each of the binders obtained and the commercial paste was placed in quantities of 1 kg each in a graphite crucible.

The four crucibles were brought to 900° C. in a nitrogen atmosphere in a period of time of approximately 10 hours, with a thermal ramp of approximately 90° C./hour. On reaching this temperature the furnace was turned off and left to cool for 4 hours. The material formed in this way was extracted and characterised.

The physical properties obtained are given herein below:

| | Density ($g/cm^3$) | Modulus of compression rupture (MPa) | Electrical resistivity (μΩ m) | Thermal conductivity (W/(m * k)) | Weight loss in during baking (%) |
|---|---|---|---|---|---|
| Green 1 | 1.22 | 18.5 | 60 | 8.2 | 41 |
| Green 2 | 1.25 | 23.7 | 58 | 7.8 | 39 |
| Green 3 | 1.1 | 13.1 | 63 | 6.9 | 42 |
| Commercial paste (comparison) | 1.26 | 12.1 | 77 | 6.5 | 23 |

All the binders (A) analysed show improved properties of mechanical strength compared to the commercial paste. The Green 2 binder in particular shows approximately double mechanical strength compared to the commercial paste.

The electrical resistivity and thermal conductivity are also better in the case of the Green 1, Green 2 and Green 3 binders compared to the commercial paste.

The binders known as Green 1, 2 and 3 represent, in some cases, a significant improvement in relation to the state of the art, although demonstrating a considerable loss in weight which is also translated into a shrinkage of the material.

Example 2

This example illustrates the properties of the material obtained by mixing the binder with the coarse phase according to the present invention to obtain an electrode paste in comparison with pastes containing only a coarse phase and pastes containing solid sugars.

Binder+coarse phase=Green paste

The following are the quantities of substances used for the production of the Green pastes.

| Ingredient | Green 4 (%) | Green 5 (%) | Green 6 (%) (comparison) | Green 7 (%) (comparison) |
|---|---|---|---|---|
| Coarse anthracite | 47 | 47 | 67 | 51 |
| Fine graphite (0-0.1 mm) | 20 | 20 | — | 22 |
| Saccharose | 25 | 25 | 25 | 27 |
| Boric acid | — | 1 | — | — |

-continued

| | | | | |
|---|---|---|---|---|
| $H_2O$ | 8 | 7 | 8 | — |

| Ingredient | Green 4 (g) | Green 5 (g) | Green 6 (g) (comparison) | Green 7 (g) (comparison) |
|---|---|---|---|---|
| Coarse anthracite | 1400 | 1400 | 2010 | 1400 |
| Fine graphite (0-0.1 mm) | 600 | 600 | — | 600 |
| Saccharose | 750 | 750 | 750 | 750 |
| Boric acid | — | 30 | — | — |
| $H_2O$ | 240 | 210 | 240 | — |

The component substances of the binder (A) were mixed for approximately 40 min. until a homogeneous paste was obtained with plastic consistency and moist appearance, using the same procedure illustrated in example 1 relating to Green 1.

Calcined anthracite powder (coarse phase) was then added to the binder (A) with average particle size comprised between 0.5 and 20 mm for about 97% while mixing until a homogeneous paste was obtained: the four formulae indicated above were obtained (Green 4, Green 5, Green 6 and Green 7).

The pastes (Green 4, Green 5, Green 6 and Green 7) obtained were placed in four graphite crucibles. 3 kg of commercial paste were added to a fifth graphite crucible. The five crucibles were brought to a temperature of 900° C. in a nitrogen atmosphere for approximately 10 hours, with a thermal ramp of approximately 90° C./hour.

On reaching this temperature the furnace was turned off and left to cool for 4 hours. The material formed in this way was extracted and analysed.

The physical characterisation of the materials provided the following results:

| | Density ($g/cm^3$) | Modulus of compression rupture (MPa) | Electrical conductivity (μΩ m) | Thermal conductivity (W/(m * k)) | Loss in weight during baking (%) |
|---|---|---|---|---|---|
| Properties required | >1.20 | >8 | <150 | >5 | <30 |
| Green 4 | 1.21 | 8.2 | 118 | 6.9 | 28 |
| Green 5 | 1.22 | 9.1 | 109 | 7.2 | 24.5 |
| Green 6 (comparison) | 1.15 | 3 | (not measurable) | (not measurable) | 28 |
| Green 7 (comparison) | 1.11 | 1.5 | (not measurable) | (not measurable) | 20 |
| Commercial paste | 1.26 | 12.1 | 77 | 6.5 | 23 |

The characterisation given above shows that the properties obtained from the Green 4 and Green 5 formulae which are the object of the present patent application show adequate characteristics for use in Soederberg electrodes, while in the absence of water (Green 7) or of the fine phase (Green 6) an extremely brittle material is obtained with characteristics different from conventional electrodes and therefore not suitable for use as electrode paste.

Example 3

This example is given in order to illustrate the reduced contents of compounds bearing R45 risk phrases in the electrode paste and the effect thereof on the reduction of PAH emissions during the baking of the same paste in conditions of heating of the electrode paste comparable to the real ones.

Three different pastes containing sugar were prepared with the following composition:

| Ingredient | Green 4a (%) | Green 5a (%) | Green 8 (%) |
|---|---|---|---|
| Coarse anthracite | 47 | 47 | 47 |
| Fine graphite (0-0.1 mm) | 20 | 20 | 20 |
| Saccharose | 25 | 25 | |
| Molasses | | | 32 |
| Boric acid | — | 1 | — |
| $H_2O$ | 8 | 7 | 2 |

The Green 4a and Green 5a pastes are identical both as composition and as preparation to the pastes Green 4 and Green 5 (see Example 2).

The Green 8 paste was obtained by replacing the saccharose with molasses using the same method of preparation of the Green 4 and Green 5 pastes shown in Example 2. The molasses were obtained by mixing 80% sugar, 18% water and 2% boric acid, placed in a stove at 90° C. for 10 hours. The system loses 12% of its weight (mainly due to evaporation of the water) and becomes an amber colour transparent liquid, very viscous, similar to honey.

For each of the three formulae 40 kg of paste were prepared.

Each paste was inserted in an iron cylinder closed at the base with internal diameter of 270 mm and height of approximately 1 m. Near the top of the cylinder a fumes extraction system was positioned in order to capture the emissions to be analysed.

The paste inside the cylinder was brought to the temperature by means of a copper coil approximately 70 mm high, defined as inductor, arranged around the cylinder and connected to an induction heating system. A power of 10 kW was applied to the inductor. The inductor positioned transversely to the axis of the cylinder was brought from the bottom upwards. The translation speed was set at 80 mm/hour.

The purpose of this methodology is to reproduce the conditions of the electrode paste during its transformation into electrode material.

The same procedure was repeated using ovules of commercial paste.

Analysis of the PAH Content in the Electrode Paste Before Baking

An analysis was carried out of the PAHs contained in a conventional paste for electrodes (COMMERCIAL PASTE) and in the three pastes (Green 4a, Green 5a, and Green 8) according to the invention, before baking, using the EPA 3541:1994+EPA 8310:1986 method.

| Paste | PAH (mg/kg) |
|---|---|
| GREEN 4a | <0.01 |
| GREEN 5a | <0.01 |
| GREEN 8 | <0.01 |
| Commercial paste (comparison) | 5166 |

The analyses confirm for the commercial paste the classification of the substance as carcinogenic (R45 risk phrases), the benzo(a)pyrene being higher than 0.005% in weight, while the green electrodes are classified as non-hazardous.

Analysis of PAH Emissions in the Atmosphere During Electrode Baking/Formation

The emissions from the extraction serving the metal cylindrical container with a quantity of mixture of 40 kg inside were sampled and subsequently analysed.

The baking phases of the four distinct electrodes known as green 4a, green 5a, green 8 and commercial paste were analysed. In all the tests the mixtures inserted in the container were brought to a temperature of approximately 400° C. and maintained at this temperature for the entire duration of the test, about 7 hours, moving the source of induction of the heat along the structure in order to simulate the different temperatures to which the electrode is subjected along its length.

During the period of time of the tests a sampling was carried out of the emission produced by the baking for the research of the PAH and VOC parameters. The NIOSH 5506-1998 method was used for the PAH while the UNI EN n 1364:2002 method was used on a phial of active carbon for the volatile organic compounds. The stack of the furnace has a diameter of 190 mm, a flow rate of 860-1100 Nm3/h, a speed of 9.1-11.1 m/s and a temperature comprised between 16-22° C.

| | Test duration (h) | Total paste (kg) | PAH mass flow g/h | PAH emission factor (gIPA/kg of paste) | PAH emission factor (mgIPA/kg of paste) |
|---|---|---|---|---|---|
| GREEN 4a | 7 | 40 | 0.00132 | 0.00023 | 0.23100 |
| GREEN 5a | 7 | 40 | 0.01032 | 0.00181 | 1.80600 |
| GREEN 8 | 7 | 40 | 0.001548 | 0.00027 | 0.27090 |
| Commercial paste (comparison) | 7 | 40 | 1.488 | 0.26040 | 260.40000 |

Comparing the commercial paste electrode with the GREEN electrodes of the present invention, it appears that the emission factor of the commercial paste is 100 times greater compared to the GREEN 5a electrode (worst case).

Comparing one with the other the various green electrodes, it is apparent that the emission factors are comparable.

It is also remarked that traces of PAH were not found in the condensate (glycol).

The values found in emission of volatile organic compounds are negligible for all the samples tested (of the order of 1-3 g/h).

Example 4

The purpose of this example is to illustrate the mechanical properties of the electrode paste which is the object of the present invention in baking conditions assimilable to the process experimented by the same paste during self-baking in Soederberg electrode.

The process used in example 3 for Green 4a, Green 5a and Green 8 transformed the paste into solid and resistant materials. The same process was performed on commercial paste allowing an equally solid material to be obtained.

The materials Green 4a, Green 5a, Green 8 and commercial paste were brought in a nitrogen atmosphere to 800° C. in 10 hours, with a thermal ramp of approximately 80° C./hour.

On reaching this temperature the furnace was turned off and left to cool for 4 hours. The material formed in this way was extracted and analysed.

The following properties were obtained:

| | Density ($g/cm^3$) | Modulus of compression rupture (MPa) |
|---|---|---|
| Green 8 | 1.18 | 3.5 |
| Green 4a | 1.20 | 4.1 |
| Green 5a | 1.23 | 6.9 |

-continued

| | Density ($g/cm^3$) | Modulus of compression rupture (MPa) |
|---|---|---|
| Commercial paste (comparison) | 1.20 | 7.3 |

The example shows that also in conditions of high thermal stress the electrode material obtained from the paste which is the object of the present invention maintains features very similar to the paste of the commercial paste type.

More particularly, the Green 5a paste shows mechanical strength only slightly lower than the commercial paste, demonstrating that it is particularly suitable for withstanding conditions of strong thermal stress during its phase of transformation and is therefore adequate for an industrial use as Soederberg paste in furnaces for the production of ferro-alloys.

Example 5

This example illustrates the properties of the material obtained by using PEG instead of water to obtain a Soederberg electrode paste according to the present invention.

For this purpose a paste is prepared containing PEG 1500, referred as Green 10, to be compared with the paste Green 5b equal to paste 5a of example 3 in accordance with the invention wherein the fine graphite has been replaced with the fine anthracite.

The following are the quantities of substances used for the production of the Green 10 and Green 5b pastes.

| Ingredient | Green 10% | Green 5b % |
|---|---|---|
| Coarse anthracite | 51 | 47 |
| Fine anthracite (0-0.1 mm) | 21 | 20 |
| Saccharose | 18 | 25 |
| Boric acid | 1 | 1 |
| $H_2O$ | — | 7 |
| PEG 1500 | 9 | — |

To make the Green 10 paste, the sugar is mixed with the PEG 1500 and the boric acid for 10 minutes at 70° C.

All this is placed in a stove at 120° C. for 8 hours, mixing it all from time to time. After 8 hours a fairly viscous liquid is extracted, made up of two non-mixable phases (the partially caramelised sugar and the PEG).

This liquid is mixed with the fine anthracite previously heated to approximately 100° C., mixing it all for 30 minutes, and thus obtaining the binder (A) in accordance with the invention.

The coarse anthracite used in example 2 having average particle size comprised between 0.5 and 20 mm for about 97% was subsequently added to the binder (A) obtained in this way while mixing until a homogeneous paste was obtained.

A viscous paste is obtained which is separated into small balls and left to cool. When cold, the material appears solid and compact.

For each of the two formulae 40 kg of paste were prepared.

Each paste was inserted in an iron cylinder closed at the base with internal diameter of 270 mm and height of approximately 1 m. Near the top of the cylinder a fumes extraction system was positioned in order to capture the emissions to be analysed.

The paste inside the cylinder was brought to the temperature by means of a copper coil approximately 70 mm high, defined as inductor, arranged around the cylinder and connected to an induction heating system. A power of 10 kW was applied to the inductor. The inductor positioned transversely to the axis of the cylinder was brought from the bottom upwards. The translation speed was set at 80 mm/hour.

Similarly to the procedure followed in example 2 and 4, the paste Green 5b and the paste Green 10 were brought in a nitrogen atmosphere to 800° C. in 10 hours, with a thermal ramp of approximately 80° C./hour.

On reaching this temperature the furnace was turned off and left to cool for 4 hours. The material formed in this way was extracted and analysed.

The physical characterisation of the materials provided the following results compared with the characteristics of the commercial paste of example 4:

| | Density ($g/cm^3$) | Modulus of compression rupture (MPa) | Electrical conductivity (μΩ m) |
|---|---|---|---|
| Green 10 | 1.28 | 9.1 | 276 |
| Green 5b | 1.23 | 6.9 | 288 |
| Commercial paste (comparison) | 1.20 | 7.3 | 242 |

From the data given above it is found that the use of the PEG 1500 (Green 10) entails an improvement in the mechanical properties of the electrode compared to that which can be obtained by means of the Green 5a or 5b formula, demonstrating that the Green 10 paste is particularly suitable for withstanding conditions of strong thermal stress during its phase of transformation.

Consequently the Green 10 paste is particularly suitable for an industrial use as Soederberg paste in furnaces for the production of ferro-alloys.

Example 6

This example illustrates how the Green 10 paste can be used in a Soederberg industrial furnace for the production of ferro-alloys. The paste obtained by following the Green 10 formula was charged in an electrode container of a Soederberg submerged arc furnace for the production of ferro silicon manganese, equipped with electrodes 800 mm in diameter. An electrode was charged with the Green 10 paste while the other two functioned with electrodes with traditional technology (commercial paste).

A metal lining with cylindrical shape with diameter of 800 mm was plugged at the base by the welding of a metal bottom. Approximately 4 tonnes of paste with Green 10 formula were charged in the column and the electrode was brought to functioning regime by means of the procedure conventionally used for starting up Soederberg electrodes in submerged arc furnaces.

The electrode with Green 10 paste became perfectly operational after approximately 24 hours from the start of the ignition procedure. The electrode current reached the operational current of 39,000 A. In these conditions the electrode of the invention works according to the same modes as standard electrodes. The temperature measured on the surface of the electrode of the invention is 1050° C.

During the operations of management of the electrode it was observed that the transformation of the Green 10 paste into electrode material takes place at a lower temperature compared to the traditional type of paste.

This leads to much shorter times of the reaching of full operability of the system in the start-up phases or in the case wherein an electrode has to be reconstructed. Moreover during the phase of normal operations the backing zone (the zone wherein the paste is transformed from viscous to solid by means of baking) is very far above the current conducting plates, causing a greater versatility in the handling of the electrode in unstable furnace situations (mineral/carbon mixtures not optimised, special ferro silicon manganese alloys with high melting point) and in conditions where frequent electrode extensions are required (when the mineral/carbon mixture is such as to cause high electrode consumptions).

The temperatures measured on the surface of the electrodes during functioning are the following:

| | Green 10 | Commercial paste |
|---|---|---|
| Temp. 40 cm under current-conducting plates | 1050° C. | 1100° C. |
| Temp. 1 m under plates | 1150° C. | 1150° C. |
| Temp. 1 m on electrode tip | 1250° C. | 1200° C. |

Pieces of electrode were also taken from the industrial production system after the same operated at temperatures comprised between 1000° C. and 2000° C. and were measured cold:

| | Density ($g/cm^3$) | Modulus of compression rupture (MPa) | Electrical conductivity (μΩ m) |
|---|---|---|---|
| Green 10 | 1.26 | 13.1 | 72 |
| Commercial paste (comparison) | 1.27 | 12.3 | 65 |

The operating temperature of the Green 10 electrode is therefore equal to that obtained with conventional technology. After 30 days of continuous operations the electrode did not show breakages which required the interruption of operations.

The invention claimed is:

1. An electrode paste of the non-metallic type for obtaining self-baked Soederberg electrodes for the electro-thermal production in submerged arc furnaces of ferro-alloys, consisting of a mixture of:

(A) 10-90% by weight, with respect to the weight of the paste, of a binder consisting of a mix of fine graphite and/or anthracite powder having particle size smaller than 0.2 mm for at least 95% of particles in said mix, at least one carbohydrate admixed with a solvent and/or dispersant for said carbohydrate, and optional additives in a total amount between 0.1% and 10% by weight with respect to the total weight of the paste, (B) 90-10% by weight, with respect to the weight of the paste, of a coarse powder of non-metallic grain particles of a material not containing metal, said powder having particle size greater than 0.2 mm, wherein the optional additives are selected from the group consisting of boric acid; silicic acid; phosphoric acid; ammonium phosphate; stearine; saturated, mono-unsaturated or polyunsaturated fatty acids; organic acids; and s mixtures thereof, and said additives are between 1% and 5% with respect to the total weight of the paste when said additives are based on metalloids and transition metals, wherein the coarse powder of (B) is a powder selected from the group consisting of anthracite, graphite, calcined anthracite, calcined graphite, electro-calcined anthracite, electro-calcined graphite and mixtures thereof, and wherein said at least one carbohydrate is selected from the group consisting of monosaccharides, disaccharides, and oligosaccharides.

2. The electrode paste according to claim 1, wherein in the binder (A) the concentration of the fine powder is between 60% and 30% by weight with respect to the total weight of the binder (A), the concentration of the at least one carbohydrate is between 30% and 50%, and the concentration of the solvent and/or dispersant is between 5% and 20%, and the solvent and/or dispersant is water and/or of polyethylene glycol (PEG).

3. The electrode paste according to claim 1, wherein the concentration of the coarse powder (B) is between 60-40% by weight with respect to the weight of the paste, the concentration of the at least one carbohydrate is between 10 and 30%, the concentration of the fine powder is between 5 and 25%, the solvent and/or dispersant and the optional additives being the remaining part to 100%, and wherein the solvent and/or dispersant is water and/or PEG.

4. The electrode paste according to claim 1, wherein the optional additives are selected from the group consisting of boric acid, silicic acid, phosphoric acid, ammonium phosphate, organic acids selected from the group consisting of acetic acid, stearic acid, propionic acid, and citric acid and a mixture of said additives, and said optional additives are in a total amount between 1% and 8% by weight with respect to the total weight of the paste.

5. The electrode paste according to claim 1, wherein the at least one carbohydrate is saccharose or either a disaccharide or oligosaccharide containing one or more fructose molecules.

6. The electrode paste according to claim 1, wherein said particle size of said fine graphite and/or anthracite powder of binder (A) is less than 0.1 mm.

7. The electrode paste according to claim 6, wherein said fine graphite and/or anthracite powder is micronized.

8. The electrode paste according to claim 1, wherein said solvent and/or dispersant for said at least one carbohydrate of the binder (A) is water and/or PEG.

9. The electrode paste according to claim 1, wherein said coarse powder (B) has a particle size between 0.5 and 20 mm.

* * * * *